United States Patent [19]

Bubernak

[11] Patent Number: 4,805,330

[45] Date of Patent: Feb. 21, 1989

[54] HANGER FOR A WALL COVERING

[76] Inventors: Bubernak, 119 South St., Plainville, Mass. 02762

[21] Appl. No.: 68,038

[22] Filed: Jun. 29, 1987

Related U.S. Application Data

[63] Continuation of Ser. No. 795,871, Nov. 7, 1985, Pat. No. 4,676,016.

[51] Int. Cl.[4] ..... G09F 7/22

[52] U.S. Cl. ..... 40/617; 160/383

[58] Field of Search ..... 40/11 R, 13, 603, 617; 24/456, 518, 152; 160/327, 328, 383, 392, 398, 382, 380, 395; 52/222, 273

[56] References Cited

U.S. PATENT DOCUMENTS

| | | | |
|---|---|---|---|
| 3,379,237 | 4/1968 | Worthington | 160/383 |
| 4,197,686 | 4/1980 | Baslow | 160/327 |
| 4,403,642 | 9/1983 | Morris | 160/328 |
| 4,549,334 | 10/1985 | Miller | 24/456 |
| 4,625,490 | 12/1986 | Baslow | 160/327 |

FOREIGN PATENT DOCUMENTS

| | | | |
|---|---|---|---|
| 2207954 | 3/1976 | Fed. Rep. of Germany . | |
| 2039982 | 8/1980 | United Kingdom | 160/383 |

*Primary Examiner*—Gene Mancene
*Assistant Examiner*—Cary E. Stone
*Attorney, Agent, or Firm*—Robert T. Gammons

[57] ABSTRACT

A hanger for a flexible wall covering in the form of an elongate flexible strip adapted to be attached to a wall adjacent the ceiling, provided with elastically interengageable jaws normally standing apart to admit an edge of the wall covering and thereafter interengageable to anchor the wall covering suspended therefrom in contact with the wall.

9 Claims, 1 Drawing Sheet

HANGER FOR A WALL COVERING

This is a continuation of co-pending application Ser. No. 795,871, filed on Nov. 7, 1985, now U.S. Pat. No. 4,676,016.

BACKGROUND OF THE INVENTION

Hangers for supporting fabric wall coverings are shown in U.S. Pat. Nos. 1,171,952; 3,833,046; 4,018,260; and 4,053,008. While the wall hangers shown in these patents are effective for holding a flexible panel suspended against a wall, once the panel is properly engaged therewith, because of the structure embodied therein and the closeness of the hanger to the adjacent ceiling, considerable difficulty is experienced in engaging the edge of the flexible panel with the hanger. Generally, a tool is required to expand the clamping edges to receive the edge of the panel and this requires threading the edges through the length of the hanger. This problem is especially aggravated by the fact that the resiliently engaged jaws can only be expanded in successive lengths to introduce the edge of the panel. The problem of mounting is further aggravated by the proximity of the clamping means to the ceiling which affords limited access for manipulation. It is the purpose of this invention to provide a wall hanger which will obviate the aforesaid disadvantages in a simple and expeditious manner so that the edge of the panel to be hung can be easily interengaged with the jaws of the hanger and clamped into place throughout its length without the aid of tools.

As herein illustrated, the hanger for wall coverings comprises a flat, elongate strip of generally rectangular configuration having spaced, parallel, longitudinal edges and flat front and back faces and resiliently interengageable jaws on the front face comprising a ledge projecting forwardly from the front face intermediate the longitudinal edges coextensive in length with the strip defining an upstanding lip spaced from and parallel to the front face and a latch coextensive in length with the lip resiliently supported on the face of the strip spaced from the lip by an amount to permit inserting the free edge of the wall covering to be supported between it and the lip, said latch being engageable with the lip to form the edge of the wall covering into a bite about the lip to thus anchor the edge of the wall covering to the hanger. The ledge projects forwardly from the front face of the strip at right angles thereto and the lip stands upwardly from the distal edge of the ledge. The latch is disposed below the ledge with respect to the upper edge of the strip and comprises forwardly and upwardly-inclined portions and a hook structured to embrace the lip. When the hook is disengaged from the lip, it stands in spaced, parallel relation to the lip so that there is a gap defined between the lip and the hook for freely receiving the upper edge of the hanging panel. The latch is flexibly deformable after inserting the upper edge of the panel to engage the hook with the lip. The lip at the distal edge of the ledge may be disposed at right angles thereto or at an angle inclined toward the face of the strip. The hook desirably defines an acute angle.

The invention will now be described in greater detail with reference to the accompanying drawings wherein.

The hanger herein illustrated is structured to enable suspending a sheet of fabric in the form of a decorative panel on the face of a wall, for example, adjacent the ceiling, although it is to be understood that it can be used to attach the panel to the wall at a position spaced downwardly from the ceiling and, further, is adapted to be used to attach the edges at opposite sides of the panel and the lower edge of the panel to the wall. As illustrated, since the structure for these several purposes is identical, it will be described with reference to attaching the upper edge of the panel to the wall.

Figure 1:
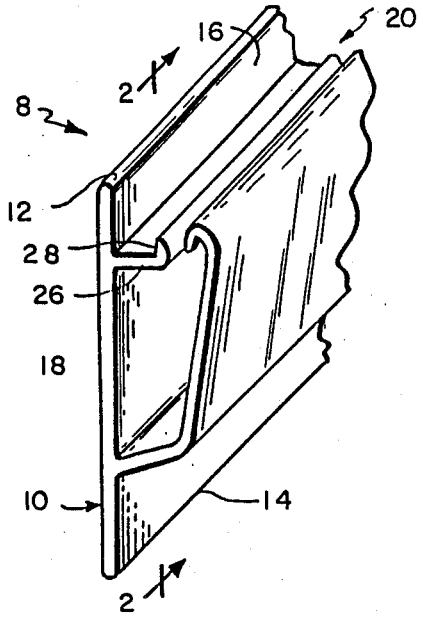
FIG. 1 is a fragmentary perspective of the wall hanger.

Referring specifically to the drawings, FIG. 1 shows the front face of a hanger 8 which is in the form of a flat, elongate strip 10 of generally rectangular configuration having spaced, parallel edges 12 and 14, a flat front face 16, a flat back face 18 and interengageable jaws 20 mounted to the front face 16. The structure is comprised of a flexible material so that it can be mounted to the surface of a wall generally indicated at 22 adjacent the ceiling indicated at 24. The structure may be adhesively attached to the wall or mechanically attached thereto by suitable fasteners inserted through the strip into the wall.

Figure 6:
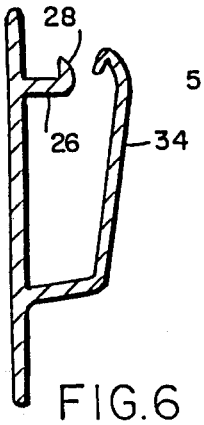
FIG. 6 shows a section like FIG. 2 wherein the lip is inclined.

The interengageable jaws 20 comprise a ledge 26 projecting forwardly from the front face 16 intermediate the opposite edges 12 and 14 at right angles thereto, at the forward extremity of which there is an upstanding lip 28. The lip 28 may be at right angles to the ledge 26 or may be inclined rearwardly toward the strip 10, FIG. 6. The jaws further comprise a latch 30 supported on the surface 16 adjacent to, but below, the ledge 26 which comprises a forwardly and upwardly-extending part 32 and a forwardly and upwardly-extending part 34, the latter having at its upper end a hook 36 provided with a depending portion 38 which is engageable with the upstanding lip 28.

Figure 7:
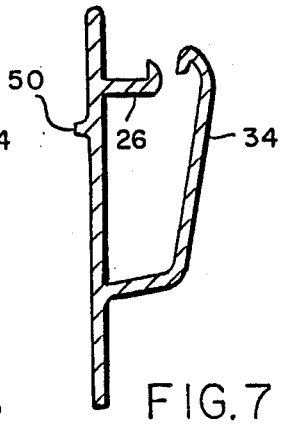
FIG. 7 shows a section like FIG. 2 wherein the strip is provided with a reinforcing rib.

A stiffening rib 50 may be provided longitudinally of the back face 18, FIG. 7.

Figure 2:
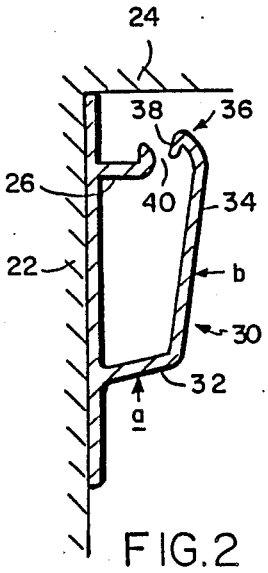
FIG. 2 is a vertical section of FIG. 1 taken on the line 2—2 with the jaws disengaged.
Figure 3:
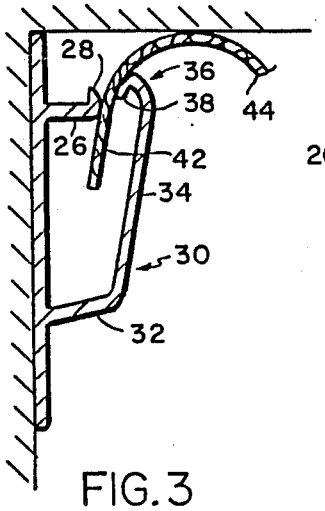
FIG. 3 is a view similar to FIG. 2 showing an edge of the wall covering disposed between the jaws.
Figure 5:
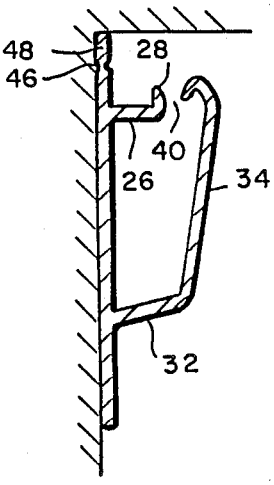
FIG. 5 shows a section like FIG. 2 with a detachable trim strip.

The structure is comprised of an elastic material and the parts 32 and 34 are disposed at an angle such that when the depending portion 38 is disengaged from the upstanding lip 28, there will be a gap 40, FIG. 2, between the same throughout the entire length of the structure of sufficient width so that the edge 42, FIG. 3, of a panel 44 which is to be suspended can be inserted through it between the upstanding lip 28 and the hook 36 as shown in FIG. 3 without having to use an implement to separate the hook from the ledge and/or without having to grasp the hook and pull it away. After the edge 42 of the panel 44 is introduced through the gap 40 between the upstanding lip and the hook 36, properly distributed throughout the length of the hanger and folded downwardly over the outer face of the part 34, the hook 36 of the latch is engaged over the lip 28 as shown in FIG. 5 to anchor the panel 44 to the hanger.

Thus, it is possible to easily mount a wall hanging without the aid of tools and to suspend it uniformly without bias in one direction or another due to the inability of uniformly distributing the edge of the material between the initially clamped jaws as disclosed in the prior art which required forced separation to admit the edge.

While the hanger shown in the figures is illustrated attached to the wall adjacent the ceiling, it is within the scope of the invention to use hangers as thus structured for securing the vertical edges of a panel and/or the lower edge of a panel.

Desirably, the hanger is so dimensioned that when attached to the wall adjacent the ceiling, the panel to be suspended will be closely adjacent the ceiling. In order to provide for some adjustment, the strip 10 may be provided with an embossment 46 lengthwise thereof as shown in FIG. 5 which enables removing a portion 48 at the upper edge so that the structure can be placed closer to the ceiling. This removable strip is also desirable when the hangers are used along the sides or at the bottom so that the hanger is not visible beyond the edges of the panel which is secured to the wall.

Figure 4:
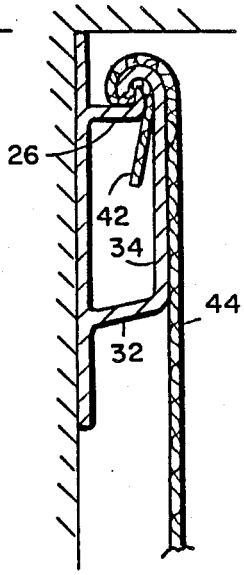
FIG. 4 is a view similar to FIG. 3 showing the jaws interengaged to anchor the fabric in place so that it is suspended therefrom.

The hanger is comprised of a flexible plastic extruded in the cross-sectional form disclosed in FIGS. 2, 3 and 4 so that the hook stands away from the lip when they are disengaged, but which permits engagement by pressure applied in the direction of the arrow a to the part 32 and pressure in the direction of the arrow b to the part 34 which, respectively, lift the hook upwardly with respect to the lip 28 and move it inwardly with respect thereto to interengage the hook with the lip.

It should be understood that the present disclosure is for the purposes of illustration only and includes all modifications or improvements which fall within the scope of the appended claims.

What is claimed is:

1. A hanger for suspending flexible sheet material to a wall, comprising an attaching strip for securing the hanger to the wall from which the sheet material is to be suspended, vertically-spaced, longitudinally-extending first and second supports integral with and extending forwardly from the attaching strip, oppositely-facing, longitudinally-extending inner and outer lips at the extremities of the supports and means yieldably supporting the second support for rectilinear and angular movement thereof relative to the first support to elastically engage the inner side of the outer lip at the extremity of the second support and the inner side of the inner lip at the extremity of the first support with the edge of the flexible sheet material to be suspended disposed between the lips.

2. A hanger according to claim 1 wherein said yieldable means is an integral part of the second support.

3. A hanger according to claim 1 wherein said second support means is disposed at an obtuse angle to said yieldable means.

4. A hanger according to claim 1 wherein said yieldable means extends forwardly from the attaching strip at an upwardly-inclined angle.

5. A hanger according to claim 1 wherein the lip at the extremity of the first support extends upwardly relative to the lip at the extremity of the second support and the lip at the extremity of the second support extends downwardly relative to the lip at the extremity of the first support.

6. A hanger according to claim 1 wherein when the second lip is interengaged with the first lip, the second lip defines a supporting surface substantially parallel to the attaching strip.

7. A hanger according to claim 1 wherein the elasticity of said support is such that when the second lip is disengaged from the first lip, the second lip is spring-biased to a position spaced from the first lip such as to provide a space between the first and second lips.

8. A hanger according to claim 1 wherein the lip at the extremity of the second support is inclined relative to the support such as to define a biting edge for frictional engagement with the edge of the flexible sheet material disposed between the lips.

9. A hanger for suspending flexible sheet material to a wall, comprising an attaching strip for securing the hanger to the wall from which the flexible sheet material is to be suspended, jaws extending longitudinally of the strip comprising a first integrally-formed jaw extending forwardly from the attaching strip defining an upwardly-extending lip spaced from and parallel to the attaching strip, a second integrally-formed jaw located below the first jaw extending forwardly and upwardly from the attaching strip defining a downwardly-extending lip spaced from and parallel to the attaching strip, said second jaw comprising angularly-disposed first and second portions, said first portion being connected to the attaching strip and said second portion to the first portion, said first and second portions being angularly and rectilinearly movable relative to the first jaw to engage the lower edge of the downwardly-extending lip with the upper edge of the upwardly-extending lip to clamp the upper edge of the flexible sheet material disposed between the opposed edges in suspension in engagement with the front face of the second jaw and with its upper edge disposed in the space defined by the attaching strip and the jaws

* * * * *

UNITED STATES PATENT AND TRADEMARK OFFICE

CERTIFICATE OF CORRECTION

PATENT NO. : 4,805,330

DATED : February 21, 1989

INVENTOR(S) : John Bubernak

It is certified that error appears in the above-identified patent and that said Letters Patent is hereby corrected as shown below:

Page One, Item No. 76, before "Bubernak" insert --John--

Signed and Sealed this

Nineteenth Day of September, 1989

*Attest:*

DONALD J. QUIGG

*Attesting Officer*

*Commissioner of Patents and Trademarks*

US004805330B1

REEXAMINATION CERTIFICATE (2664th)

United States Patent [19]

Bubernak

[11] B1 4,805,330

[45] Certificate Issued Sep. 5, 1995

[54] HANGER FOR A WALL COVERING

[76] Inventor: John Bubernak, 119 South St., Plainville, Mass. 02762

Reexamination Request:
No. 90/003,239, Nov. 2, 1993

Reexamination Certificate for:

| | |
|---|---|
| Patent No.: | **4,805,330** |
| Issued: | **Feb. 21, 1989** |
| Appl. No.: | **68,038** |
| Filed: | **Jun. 29, 1987** |

Certificate of Correction issued Sep. 19, 1989.

Related U.S. Application Data

[63] Continuation of Ser. No. 795,871, Nov. 7, 1985, Pat. No. 4,676,016.

[51] Int. Cl.[6] ..... G09F 7/22
[52] U.S. Cl. ..... 40/617; 160/383

[56] References Cited

U.S. PATENT DOCUMENTS

| | | |
|---|---|---|
| 17,413 | 6/1857 | Bates . |
| 21,703 | 10/1858 | Shaler . |
| 444,832 | 1/1891 | Hartshorn . |
| 917,106 | 4/1909 | McGee . |
| 1,171,952 | 2/1916 | Higgin . |
| 1,758,720 | 5/1930 | Sodergren . |
| 2,325,500 | 7/1943 | Fosberg . |
| 2,335,361 | 11/1943 | Schiller . |
| 2,910,033 | 10/1959 | Weisburg . |
| 3,099,058 | 7/1963 | Pettingell . |
| 3,126,444 | 3/1964 | Taylor . |
| 3,214,314 | 10/1965 | Rowbottam . |
| 3,225,407 | 12/1965 | Daniels . |
| 3,379,237 | 4/1968 | Worthington . |
| 3,495,306 | 2/1970 | Eichberg . |
| 3,517,702 | 6/1970 | Mueller et al. . |
| 3,552,476 | 1/1971 | Le Tarte . |
| 3,682,163 | 8/1972 | Plummer . |
| 3,751,771 | 8/1973 | Vipond . |
| 3,786,171 | 1/1974 | Shira . |
| 3,833,046 | 9/1974 | Tombu . |
| 3,851,848 | 12/1974 | Wiele . |
| 4,018,260 | 4/1977 | Baslow . |
| 4,053,008 | 10/1977 | Baslow . |
| 4,089,075 | 5/1978 | May . |
| 4,197,686 | 4/1980 | Baslow . |
| 4,279,061 | 7/1981 | Santo . |
| 4,403,642 | 9/1983 | Morris . |
| 4,473,927 | 10/1984 | Miller . |
| 4,549,334 | 10/1985 | Miller . |
| 4,566,236 | 1/1986 | Pound . |
| 4,578,136 | 3/1986 | Brown . |
| 4,625,490 | 12/1986 | Baslow . |

FOREIGN PATENT DOCUMENTS

| | | |
|---|---|---|
| 1101751 | 5/1981 | Canada . |
| 2207954 | 3/1976 | Germany . |
| 1474152 | 5/1977 | United Kingdom . |
| 2039982 | 8/1980 | United Kingdom . |

*Primary Examiner*—Brian K. Green

[57] ABSTRACT

A hanger for a flexible wall covering in the form of an elongate flexible strip adapted to be attached to a wall adjacent the ceiling, provided with elastically interengageable jaws normally standing apart to admit an edge of the wall covering and thereafter interengageable to anchor the wall covering suspended therefrom in contact with the wall.

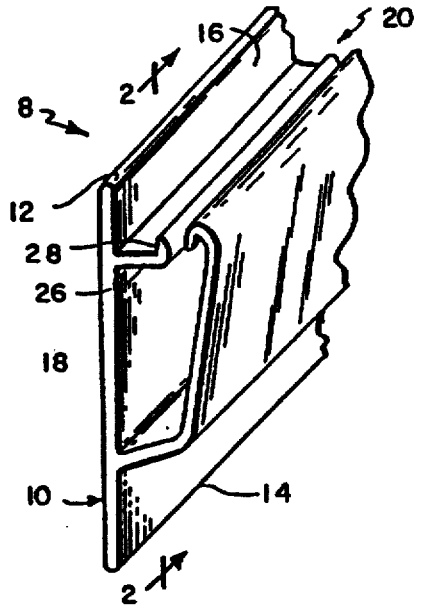

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 4 is confirmed.

Claims 1-3 and 5-9 are cancelled.

* * * * *